United States Patent [19]

Hoff et al.

[11] Patent Number: 4,773,249

[45] Date of Patent: Sep. 27, 1988

[54] HOSE FITTING CRIMPER

[75] Inventors: Steven R. Hoff, New Haven, Ind.; Richard I. Wermer, Hicksville, Ohio

[73] Assignee: Dana Corporation, Toledo, Ohio

[21] Appl. No.: 935,194

[22] Filed: Nov. 26, 1986

[51] Int. Cl.[4] ..... B21D 41/04; B23P 11/00

[52] U.S. Cl. ..... 72/402; 29/237

[58] Field of Search ..... 72/402, 399, 393, 452; 29/237

[56] References Cited

U.S. PATENT DOCUMENTS

| | | | |
|---|---|---|---|
| 3,047,043 | 7/1962 | Albrecht . | |
| 3,662,450 | 5/1972 | Kish et al. | 29/237 |
| 3,851,514 | 12/1974 | Chen et al. | 72/402 |
| 4,034,592 | 7/1977 | Chen et al. | 72/402 |
| 4,034,593 | 7/1977 | Patel | 72/402 |
| 4,118,970 | 10/1978 | Patel | 72/402 |
| 4,189,817 | 2/1980 | Moebius | 29/237 |
| 4,244,091 | 1/1981 | Kimble et al. | 29/237 |
| 4,285,228 | 8/1981 | Gunning | 72/402 |
| 4,309,892 | 1/1982 | Currie | 72/402 |
| 4,515,006 | 5/1985 | Stanley | 72/402 |
| 4,535,822 | 8/1985 | Rogers, Jr. | 139/99 |
| 4,550,587 | 11/1985 | Eisenzimmer | 72/402 |

*Primary Examiner*—Daniel C. Crane

*Attorney, Agent, or Firm*—Harold F. Mensing; Frank B. McDonald; Robert M. Leonardi

[57] ABSTRACT

A mechanism and method for operating a device for crimping a metal outer sleeve of a hose connector around the end of a flexible hose. The device has a constrictor collet assembly for radially inwardly deforming the sleeve in response to axial movement of the collet assembly in a frusto conical die ring. Axial movement is imparted by a ram and a pair of pusher members mounted between the ram face and the collet assembly. The pusher members are swung between open and closed positions by the operating mechanism which has a pair of lever arms connected to the pusher members at one end and to a pintle at the other end. The pintle is slidably mounted for lateral movement in a slot. It is resiliently biased towards a forward end of the slot such that one element of the operating mechanism can be advanced to a first position whereat the pusher halves are closed and then further advanced to a second position into contact with a switch that activates the ram and causes the pusher members to shove the constrictor collet assembly axially deeper into the frusto conical die ring.

16 Claims, 5 Drawing Sheets

HOSE FITTING CRIMPER

BACKGROUND OF THE INVENTION

This invention relates to a method and related apparatus for affixing a fitting on the end of a flexible hose by constricting an outer metal sleeve of the fitting tightly around an end portion of the hose. More specifically, it relates to a crimping method and apparatus wherein the operating mechanism provides for a positive delay from the time of the lateral closing of a pair of ram driven pusher members to the time of the beginning of a ramming cycle. During the ramming cycle the pusher members, which are connected to the ram, are driven axially into contact with a constrictor collet assembly loosely seated in a coaxially aligned frusto conical die ring. Segments of the collet assembly are forced radially inward, thus constrictively deforming the fitting sleeve, as the collet assembly is rammed axially deeper into the frustoconical die ring.

Preferably the pusher halves are closed manually by mechanical means rather than automatically. This coupled with the fact that the initiation of the ramming cycle is delayed momentarily provides a margin of safety and enables the operator to reverse the action instantly, before the greater force of the ram is applied, in the event he senses his hand is in the way or the workpiece is not loaded properly.

SUMMARY OF THE INVENTION

The collet type crimping device disclosed herein is comprised of components which can be divided into groups relating to the frame, the ram, the pusher members, the constrictor die assembly and the operating mechanism. The frame has a plurality of spaced apart parallel columns rigidly connected together at one end by a base plate and at the other end by stationary components of the ram assembly. The constrictor die assembly includes an axially movable collet assembly loosely seated in a stationary die ring contained in the base plate. Axial movement of the collet assembly from a large end of the die ring towards a smaller end thereof will cause segments of this assembly to be forced radially inward thereby constrictively deforming the end portion of a workpiece confined in the collet assembly.

Force is applied to the large end of the collet assembly by a coaxially aligned ram through a pair of pusher members mounted between the operating end of the ram and the collet assembly. When the ram is in its retracted position the pusher members can be swung laterally between closed and open positions by means of levers of the operating mechanism which also activates the ram. The operating mechanism is designed to provide a positive mechanical delay between the closing of the pusher members and the initiation of the ramming cycle. In the disclosed invention this is accomplished by providing a resilient connection between a manually operated reciprocable member and the adjoining ends of the pusher member levers. This permits overtravel of the reciprocable member after the pusher members have been fully closed. A ram activating switch is positioned such that its activation and deactivation occur respectively after the pusher members have been closed and before they are reopened.

The invention and its advantages will be understood best if the following description is read in conjunction with the accompanying drawings.

DETAILED DESCRIPTION OF THE INVENTION

Figure 1:
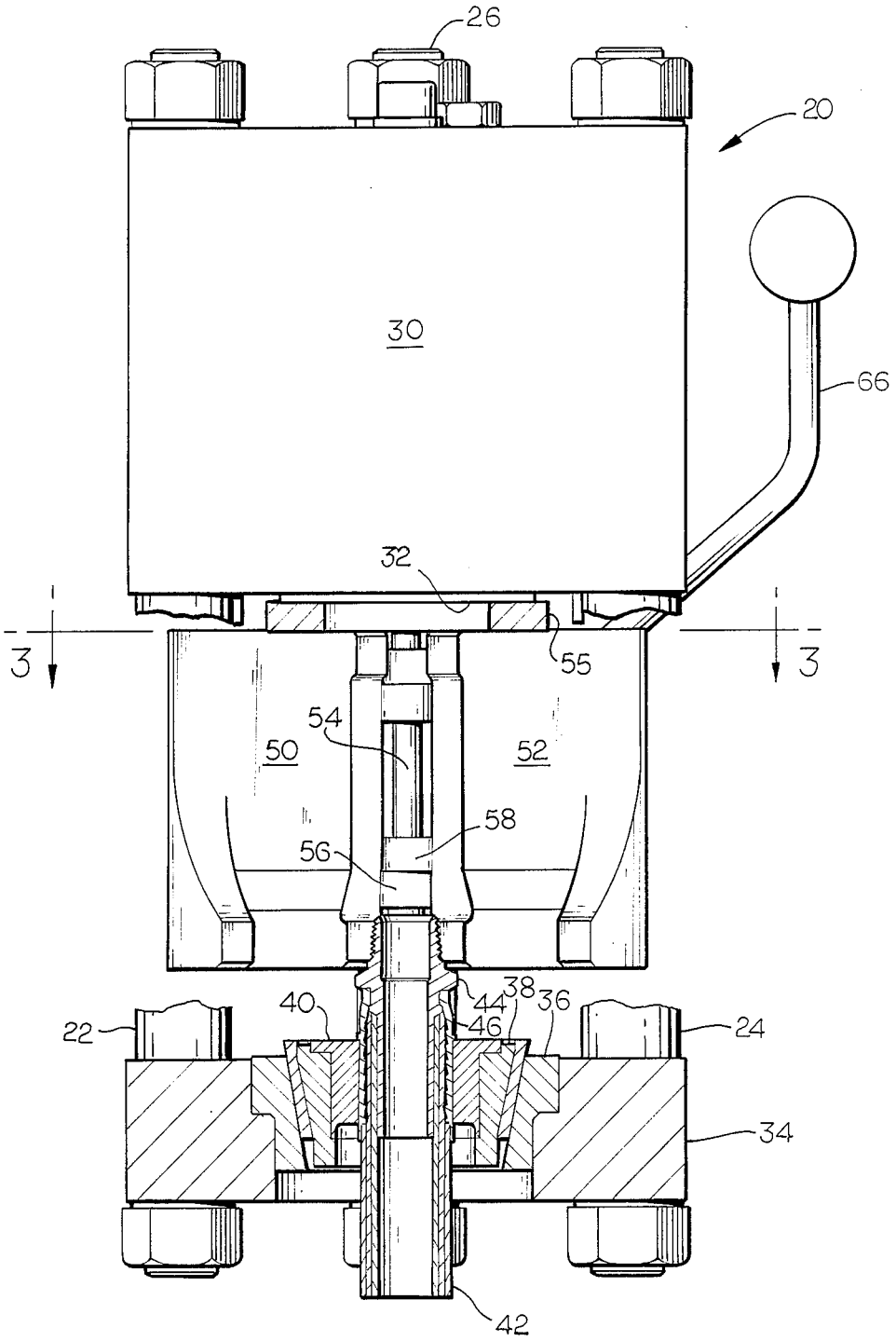
FIG. 1 is a partially sectioned front elevation view of the crimping apparatus showing its components positioned at the beginning of the crimping cycle with the ram retracted, the pusher members swung open and the workpiece loaded into the crimping die assembly.
Figure 2:
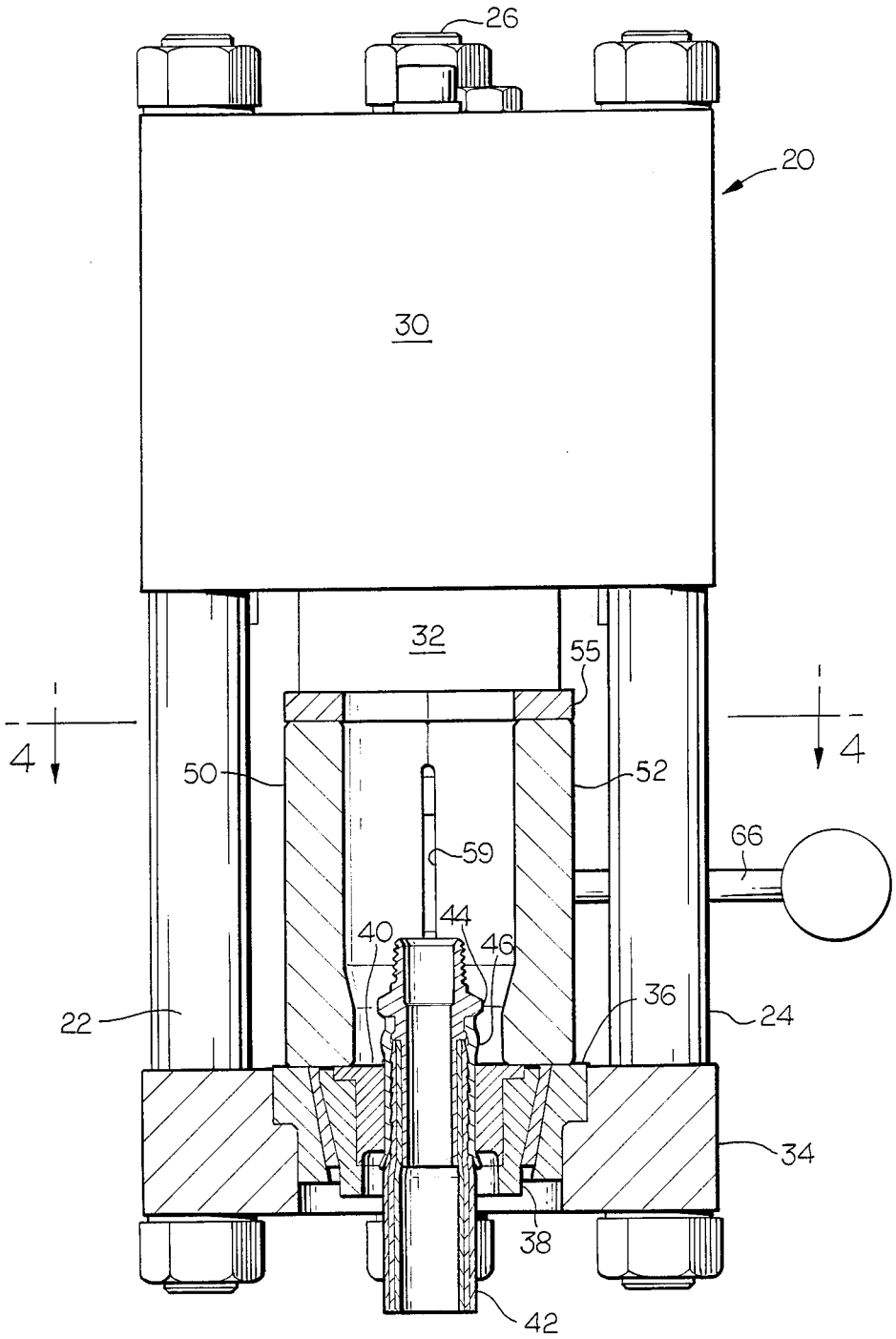
FIG. 2 is a view similar to FIG. 1 but with the ram fully extended and the collet assembly in its contracted position.
Figure 4:
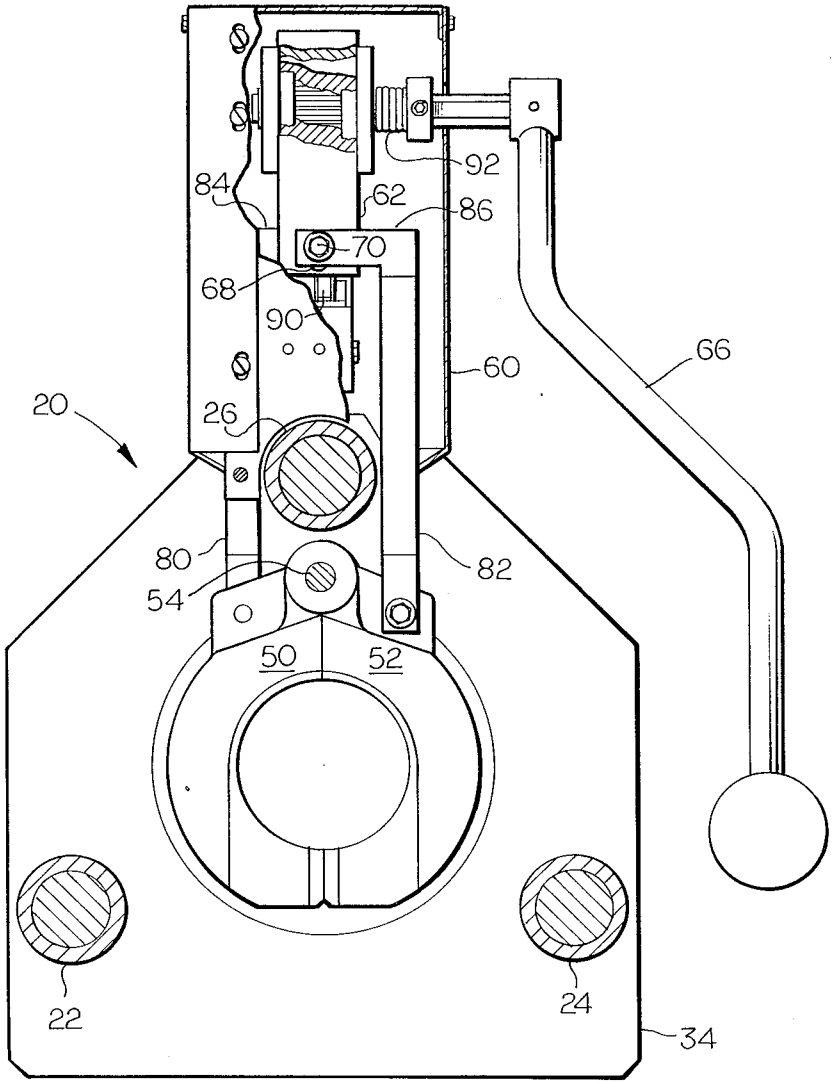
FIG. 4 is a partially sectioned view taken along lines 4—4 of FIG. 2.
Figure 3:
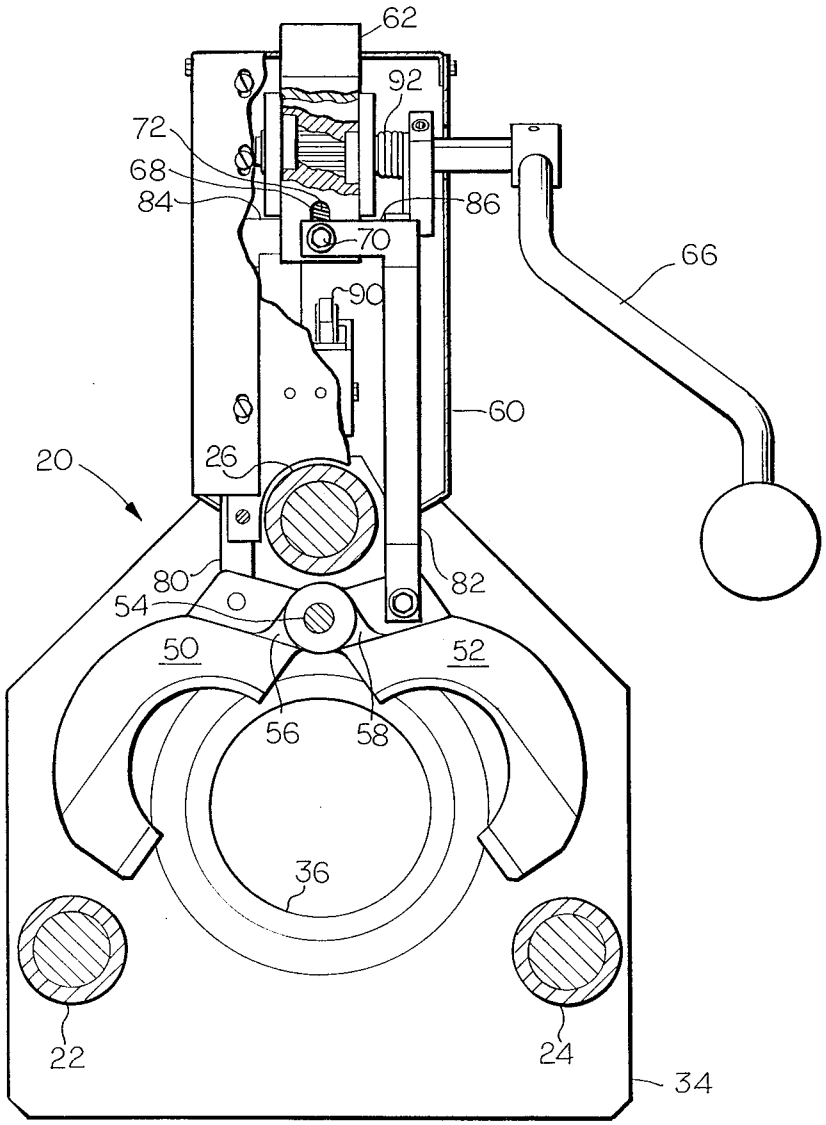
FIG. 3 is a partially sectioned view taken along lines 3—3 of FIG. 1 showing details of the crimper operating mechanism.
Figure 5:
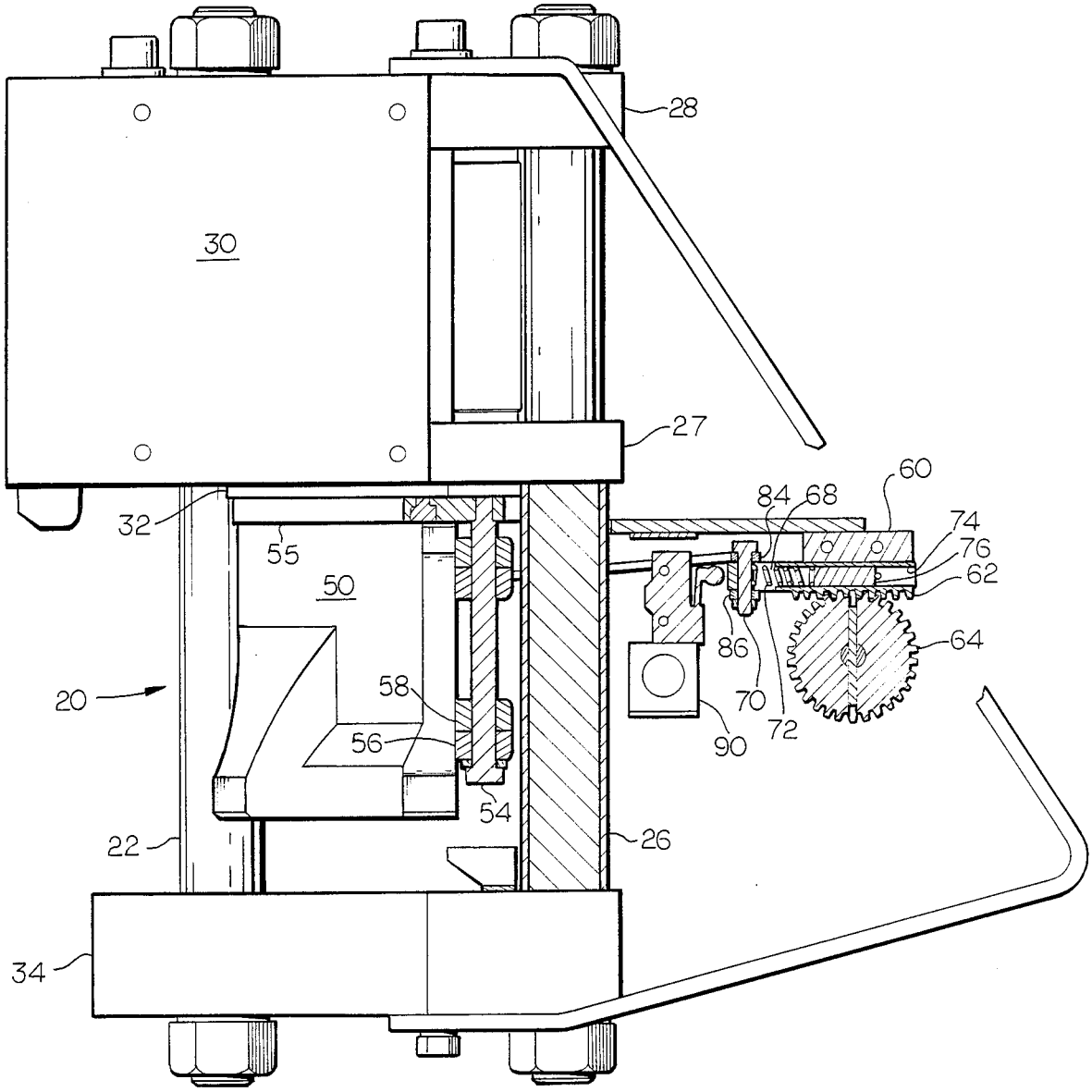
FIG. 5 is a partially sectioned side view of FIG. 2 with the components of the operating mechanism shown in their first advanced positions.
Figure 6:
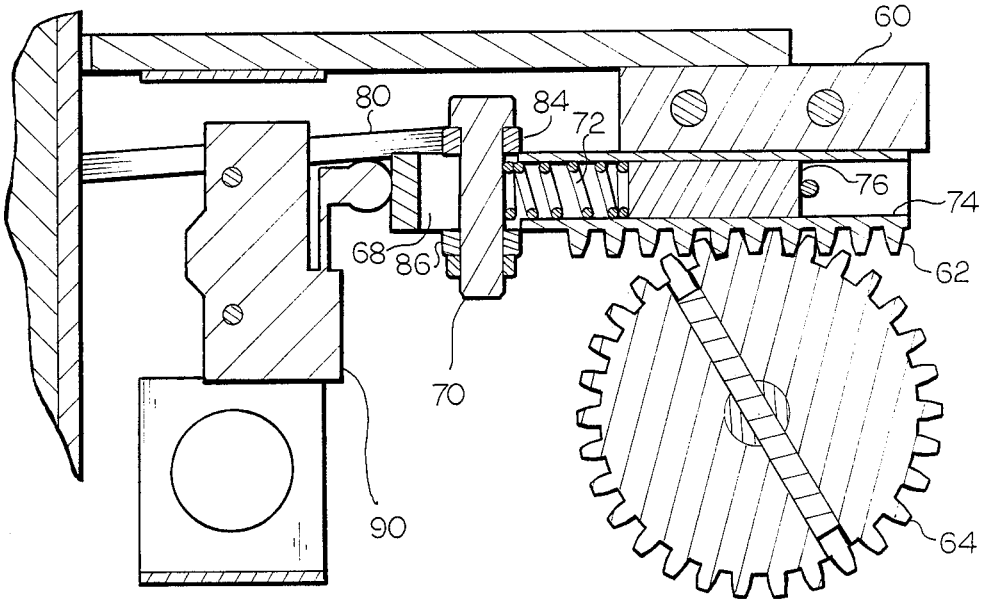
FIG. 6 is a fractional view of FIG. 5 showing the positions of these components when the operating mechanism is fully advanced.

The preferred embodiment of the crimping apparatus 20 illustrated in the drawings has a frame comprised of three parallel upright columns 22, 24, 26 spaced equidistantly from each other and disposed in a side by side triangular array. Two of the columns 22, 24 are denoted the front columns and the remaining column 26 is denoted the rear column. The upper ends of the columns are connected rigidly to spaced apart head plates 27, 28 of a ram assembly 30 having an axially extendible ram 32. The lower ends of the columns 22, 24, 26 likewise are connected rigidly to a base plate 34 which has a relatively large opening with an annular shoulder for retaining a die ring 36. The die ring, which is an outer part of the constrictor die assembly 38, has a downwardly converging frustoconical inner working surface that is coaxially aligned with the travel axis of the ram 32. The constrictor collet assembly 40 is comprised of a plurality of yieldably joined radially movable segments. It is seated loosely within the die ring 36. Collet assembly 40 is adapted to receive a cylindrical workpiece 42 preferably from its small or bottom end. In the instant case the workpiece is an end section of a flexible hose onto which has been placed a fitment 44 having an uncrimped metal outer sleeve or ferrule 46. The components of the collet assembly are sized and shaped such that when the uncrimped body of the ferrule 46 is properly positioned therein the top of the collet assembly protrudes above the top of the die ring 36. With this arrangement an axial force applied to the top of the collet assembly shoves it deeper into the die ring and as a result the converging frustoconical wall of the die ring wedges the collet segments radially inward. They in turn press radially against the outside of the ferrule, literally from all angles, with sufficient force to constrictively and permanently deform the ferrule inwardly into tight contact with the outside surface of the hose.

The axial force is supplied by the ram and is applied indirectly through a pair of pusher members 50, 52 located intermediate the ram face and the constrictor die assembly. Pusher members 50, 52 are pivotally mounted on a single hinge pin 54 affixed by its upper end to a circular abutment plate 55 firmly secured to the face of the ram. Hinge pin 54 is located adjacent to the rear column 26 of the frame and is parallel to it as well as to the travel axis of the ram. Each of the pusher members has a generally semi cylindrical shape with hinge bosses 56, 58 protruding from their sides. Accordingly the pusher members may be moved axially in unison with the ram towards and away from the collet assembly and may also be swung laterally between open and closed positions. Upper frontal portions of the pusher members may be cut away as shown in the drawings to provide visual access to the interior even after they have been pivoted into their closed position. A relief gap 59 also may be provided along the hinged edges of the members.

A manual operating mechanism 60 for opening and closing the pusher members and initiating the ramming cycle is mounted on a rear extension of abutment plate 56 so that it moves up and down in unison with the ram. This feature enables a person operating the device to sense the motion of the ram and be aware particularly of when the motion ceases. Operating mechanism 60 includes an elongated reciprocable member, such as a rack gear 62, a rotatable member, such as a spur gear 64, in engagement with the rack gear and a radially disposed handle 66 keyed to the spur gear. The rack gear 62 is disposed on top of spur gear 64 and has its longitudinal centerline aligned with the centerline of the rear column 26 and the axial centerline of the frame. A slot 68 of uniform width extends vertically through the rack gear 62 from top to bottom along a portion of its centerline preferably adjacent to the head or leading end thereof. Slot 68 contains a vertically disposed laterally slidable pintle 70 that is yieldably held in the leading end of the slot 68 by a resilient means, such as a helical spring 72, which bears against the trailing side of the pintle. The spring 72 is contained in a bore 74 extending longitudinally through the trailing end of the rack gear 62 into the trailing end of the slot. A retainer plug 76 pinned in the trailing end of the bore holds the spring in place.

The pintle 70 and the pusher members 50, 52 are operatively linked together by a pair of generally parallel levers 80, 82. The rear ends of the levers have lateral leg sections 84, 86 which extend toward each other and are pivotally mounted on the pintle. Preferably the ends of the leg sections 84, 86 are vertically spaced apart and connected to the top and bottom ends of the pintle. The front ends of levers 80, 82 are connected respectively to spaced apart pivot pins on left and right pusher members.

A micro switch 90 for controlling the flow of fluid into the ram from a remote source is positioned directly in the travel path of the head of the rack gear. It is located at a fixed point that lies intermediate the first advanced position, reached by the rack gear head at the moment the forward movement of the pintle is arrested by the closing of the pusher members, and the second advanced position of the head permitted by the yieldable connection between the pintle and rack gear. In this second position the continued forward movement of the rack gear has overcome the force of the helical spring and caused the pintle to be shifted from the leading end of its slot to the trailing end thereof.

The crimping operation involves the steps of loading a workpiece axially into the collet assembly from the bottom end, visually determining that the workpiece is properly positioned in the collet assembly and the assembly is properly seated in the frustoconical die ring, moving the pusher members from an open position to a closed position by advancing a reciprocable member of the operating mechanism to a first position, initiating the ramming cycle by continuing to advance the reciprocable member after the pusher member closing has occurred, sensing the ceasation of the ram movement, allowing the components of the operating mechanism to be automatically returned to their original positions by means of a return spring 92 connected to the handle of the operating mechanism and finally removing the workpiece axially from the collet assembly.

Although only a preferred embodiment of the invention has been illustrated and described, it is to be understood that modifications can be made without departing from the essence of the invention as defined by the appended claims.

What is claimed is:

1. An improved crimping device for affixing a fitting on the end of a flexible hose by constricting a metal outer sleeve of the fitting around an end portion of said hose, said device having a frame with two ends, a baseplate at one end, a constrictor collet die assembly mounted for axial movement in a frustoconical die ring centered in the baseplate, a coaxially aligned extendible and retractable ram at the other end, and a pair of collet assembly pusher members positioned between said ram and said collet assembly, said pusher members being mounted on an axially disposed shaft for axial movement in unison with said ram and for pivotal movement about said shaft between laterally open and laterally closed positions when said ram is in its retracted position, the improvement comprising: a means for opening and closing said pusher members and jointly activating said ram, said means having a resilient link which permits an element of said means to be advanced into contact with a ram activating switch after said pusher members have been fully closed, said resilient link being separate from said activating switch.

2. A crimping device for affixing a fitting on the end of a flexible hose by constricting a metal outer sleeve of the fitting around an end portion of said hose, said device comprising: a frame having two ends, a baseplate at one end, a constrictor collet die assembly mounted for axial movement in a frustoconical die ring centered in the baseplate, a coaxially aligned extendible and retractable ram at the other end, a pair of collet assembly pusher members positioned between said ram and said collet assembly, said pusher members being mounted on an axially disposed shaft for axial movement in unison with said ram and for pivotal movement about said shaft between laterally open and laterally closed positions when said ram is in its retracted position and a means for opening and closing said pusher members and activating said ram, said means having a resilient link which permits an element of said means to be advanced into contact with a ram activating switch after said pusher members have been fully closed, said element is a rack gear member having a slot of uniform width extending along a section of its longitudinal axis, a laterally slidable pintle contained in said slot, a pair of levers extending from said pintle to said pusher members and resilient means bearing against a side of said pintle yieldably holding said pintle against one end of said slot.

3. A crimping device according to claim 2 wherein the pintle ends of said levers straddle said rack gear member and are connected to opposite ends of said pintle.

4. A crimping device according to claim 2 wherein said resilient means is a helical spring contained in a longitudinally disposed bore within said rack gear member.

5. A crimping device according to claim 2 wherein said rack gear member has a leading end and a trailing end, a trigger finger of said switch is disposed in the forward travel path of said rack gear member and is positioned such that it is spaced ahead of said leading end while said pintle is at the forward end of said slot and is in contact with said leading end when said pintle is at the other end of said slot.

6. A crimping device according to claim 4 wherein said frame has three equally spaced apart upright columns disposed in a triangular array, said columns being rigidly connected together at said one end by said baseplate and at said other end by components of said ram, said pusher members each being pivotally mounted on said shaft along one side, one of said columns adjacent to the pivotal sides of said pusher members being designated as the rear column, the remaining two columns adjacent to the openable sides of said pusher members being designated the front columns, and said levers straddle said rear column and said rack gear member.

7. A crimping device according to claim 6 wherein the pintle ends of said levers have inwardly disposed transverse ends.

8. A crimping device according to claim 1 wherein said means is coupled to said ram and moves in unison therewith.

9. A crimping device according to claim 8 wherein said means includes a manual operating handle which moves translationally with said ram.

10. A crimping device for affixing a fitting on the end of a flexible hose by constricting a metal outer sleeve of the fitting around an end portion of said hose, said device comprising: a frame having two ends, a baseplate at one end, a constrictor collet die assembly mounted for axial movement in a frustoconical die ring centered in the baseplate, a coaxially aligned extendible and retractable ram at the other end, a pair of collet assembly pusher members positioned between said ram and said collet assembly, said pusher members being mounted on an axially disposed shaft for axial movement in unison with said ram and for pivotal movement about said shaft between laterally open and laterally closed positions when said ram is in its retracted position and an operating means for opening and closing said pusher members and jointly activating said ram, said operating means includes an electrical switch for activating said ram, a pair of levers pivotally connected to a single pintle at one end and to respective pusher members at the other end, said pintle being contained in a slot in a reciprocable element of said means and laterally slidable from one end of the slot to the other end thereof, and a resilient member yieldably holding said pintle in one end of said slot.

11. A crimping device according to claim 10 wherein said reciprocable element is a rack gear and the pintle ends of said levers straddle said rack gear member and are connected to opposite ends of said pintle.

12. A crimping device according to claim 11 wherein said resilient member is a helical spring contained in a longitudinally disposed bore within said rack gear.

13. A crimping device according to claim 11 wherein said rack gear has a leading end and a trailing end, a trigger finger of said switch is disposed in the forward travel path of said rack gear member and is positioned such that it is spaced ahead of said leading end while said pintle is at the forward end of said slot and is in contact with said leading end when said pintle is at the other end of said slot.

14. A crimping device according to claim 12 wherein said frame has three equally spaced apart upright columns disposed in a triangular array, said columns being rigidly connected together at said one end by said baseplate and at said other end by components of said ram, said pusher members each being pivotally mounted on said shaft along one side, one of said columns adjacent to the pivotal sides of said pusher members being designated as the rear column, the remaining two columns adjacent to the openable sides of said pusher members being designated the front columns, and said levers straddle said rear column and said rack gear member.

15. A crimping device according to claim 10 wherein said operating means is coupled to said ram and moves in unison therewith.

16. A crimping device according to claim 15 wherein said means includes a manual operating handle which moves translationally with said ram

* * * * *